US007905818B1

(12) United States Patent
Habing

(10) Patent No.: US 7,905,818 B1
(45) Date of Patent: Mar. 15, 2011

(54) MOLDED CUSHIONS FOR EXERCISE EQUIPMENT

(75) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 337 days.

(21) Appl. No.: 11/001,995

(22) Filed: Dec. 1, 2004

(51) Int. Cl.
*A63B 21/06* (2006.01)

(52) U.S. Cl. ..... 482/94; 482/93

(58) Field of Classification Search ..... 482/142
See application file for complete search history.

(56) References Cited

U.S. PATENT DOCUMENTS 3,861,747 A * 1/1975 Diamond ..... 297/452.49
3,912,264 A * 10/1975 Busse et al. ..... 482/72
4,568,124 A * 2/1986 Kanai ..... 297/440.22
4,834,458 A * 5/1989 Izumida et al. ..... 297/452.23
5,067,772 A * 11/1991 Koa ..... 297/452.55
5,795,276 A * 8/1998 Almeda ..... 482/142
5,964,017 A * 10/1999 Roberts ..... 29/91.1

* cited by examiner

*Primary Examiner* — Fenn C Mathew
(74) *Attorney, Agent, or Firm* — Blakely, Sokoloff, Taylor & Zafman LLP

(57) ABSTRACT

A cushioned support has a rigid base and a molded resilient cushion. The cushion is releasably attached to the base with a wrap-around lip or by means of a retaining member disposed along a periphery of the base. The retaining member, if used, may be conveniently manufactured as an extrusion with a first portion for attachment to the perimeter of the base and a second portion having a barbed cross-section for engaging the cushion.

12 Claims, 3 Drawing Sheets

MOLDED CUSHIONS FOR EXERCISE EQUIPMENT

BACKGROUND OF THE INVENTION

1. Field of the Invention

This invention relates generally to upholstery and, particularly, to a cushioned support for exercise machines, leisure furniture and the like.

2. Background

Typical seats and back rest cushions consist of sewn fabric with a soft stuffing, molded bicycle seats with a sewn fabric covering, polyurethane molded around a rigid support structure for pads on exercise equipment, and plastic-coated fabric (e.g., Naugahyde®) sewn and/or stretched over foam padding and stapled to a rigid wood backing.

Sewn fabric cushions absorb dust and dirt, take the support shape of the rigid surface it is sitting on, and is hard to clean without removing.

Molded bicycle seats are expensive to produce because of the multiple materials involved, typically an outer casing with a gel filler.

Polyurethane molded seats are molded onto and integrated with a rigid support structure. These can be molded into different shapes and support surfaces, but need to be integral with the rigid support in the molding process because the material does not have enough elasticity and memory to stretch over a rigid support structure after the molding process. This makes it expensive to offer color options or replacement seats because the entire seat needs to be changed out and shipping and inventory is more expensive.

Plastic-coated fabric seats are integrated with a rigid support structure. These can be formed into different extruding surface shapes such as a lumbar support by cutting and sewing the plastic-coated fabric around a cut shape in the foam padding, but they cannot take the form of an indent shape because the plastic-coated fabric will "pull straight" over the indent. This makes it expensive to offer color options or replacement seats because the entire seat needs to be changed out and shipping and inventory is more expensive.

SUMMARY OF THE INVENTION

The present invention provides a cushioned support having a rigid base and a molded resilient cushion. The cushion is releasably attached to the base with a wrap-around lip or by means of a retaining member disposed along a periphery of the base. The cushion may be stretched over the base or may be compressed to fit within a rim surrounding the base. The retaining member used with some embodiments may be conveniently manufactured as an extrusion with a first portion for attachment to the perimeter of the base and a second portion having a barbed cross-section for engaging the cushion.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
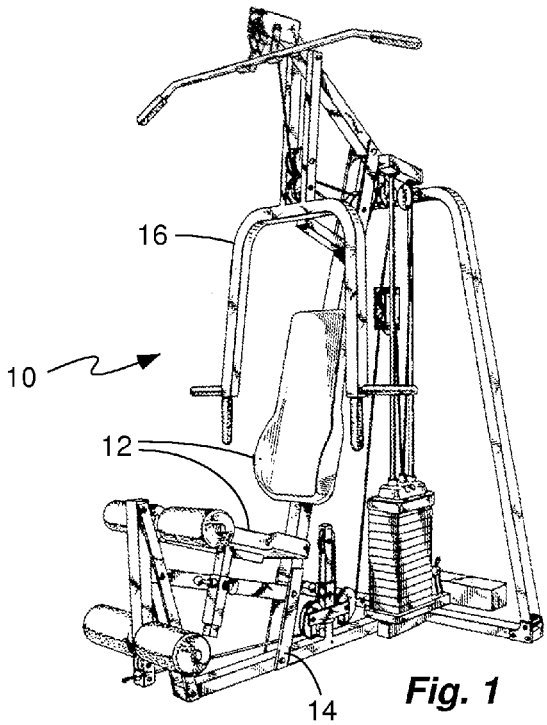
FIG. 1 is a perspective view of an exercise machine in which the cushioned support of the present invention may be employed.

FIG. 1 illustrates a typical exercise machine 10 that utilizes cushioned supports 12. The cushion supports are attached to a frame 14 of the machine and are configured to support a user performing an exercise with operable member 16. Cushioned supports of the type described herein are suitable for use with a wide variety of exercise devices. Furthermore, cushioned supports made in accordance with the present invention may be used with lawn furniture, benches, patio swings and other types of casual furniture.

Figure 2:
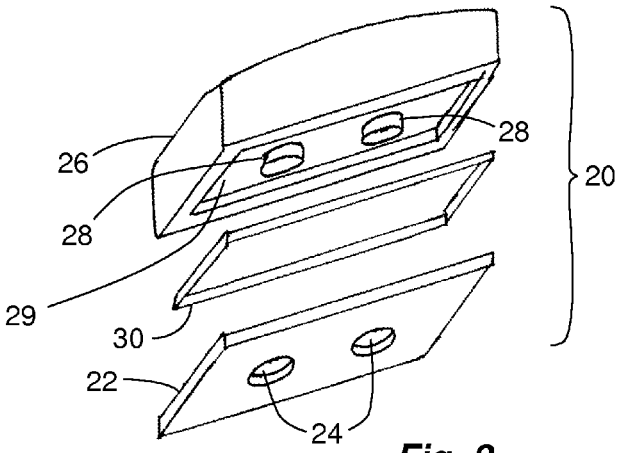
FIG. 2 is an exploded view of one embodiment of a cushioned support in accordance with the present invention.

FIG. 2 is an exploded view of one embodiment of a cushioned support 20. The rigid, substantially planar base 22 is made of wood or other suitable material, including metal or plastic. A resilient cushion 26 is molded of a plastic foam or similar material having "memory" so that it can be stretched over or otherwise fitted to base 22. A retaining member 30, versions of which will be described in greater detail below, is attached to the periphery of base 22 and includes means for engaging cushion 26 so that it becomes releasably attached to the base. The retaining member may completely encircle the base or short segments of the retaining member may be attached to the base at spaced-apart locations.

Cushion 26 is molded with projecting pegs 28. Base 22 has holes or sockets 24 to receive pegs 28. The cooperating pegs and sockets have an interference fit and help secure the cushion to the base and prevent the cushion from bulging out. Cushion 26 is also formed with a recess or well 29 to receive base 22. This prevents lateral shifting of the cushion and also hides the edges of base 22 from view.

Figure 3A:
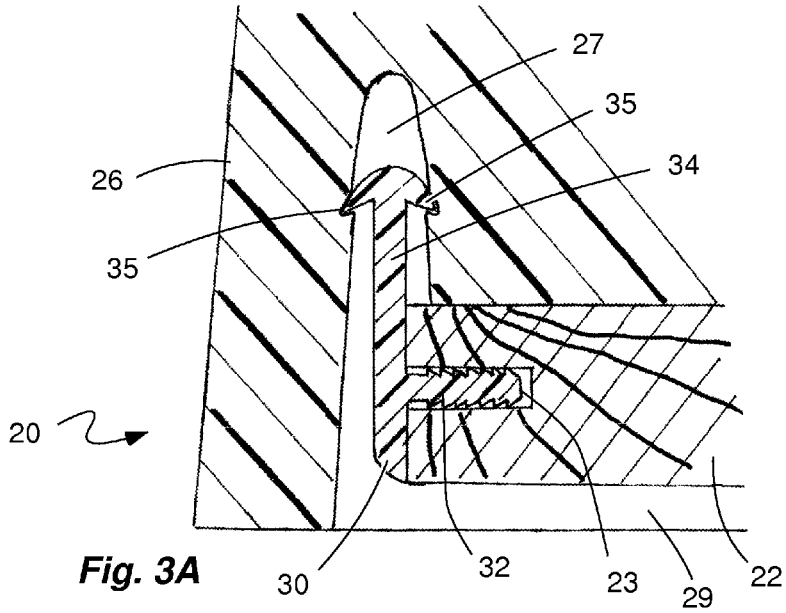
FIG. 3A is a partial cross-sectional view of an embodiment of the present invention.

FIG. 3A is a partial cross-sectional view of cushioned support 20. As can be better seen in this view, retaining member 30 has a first portion 32 that secures the retaining member to base 22. In particular, portion 32 of the retaining member is received in a channel 23 cut into the periphery of base 22. Retaining member 30 has a second portion 34 adapted to engage cushion 26. Portion 34 is tipped with a pair of barbs 35 that grip against the resilient material of which cushion 26 is made. Cushion 26 is formed with a channel 27 around the perimeter of the recess 29 to receive portion 34.

Figure 3B:
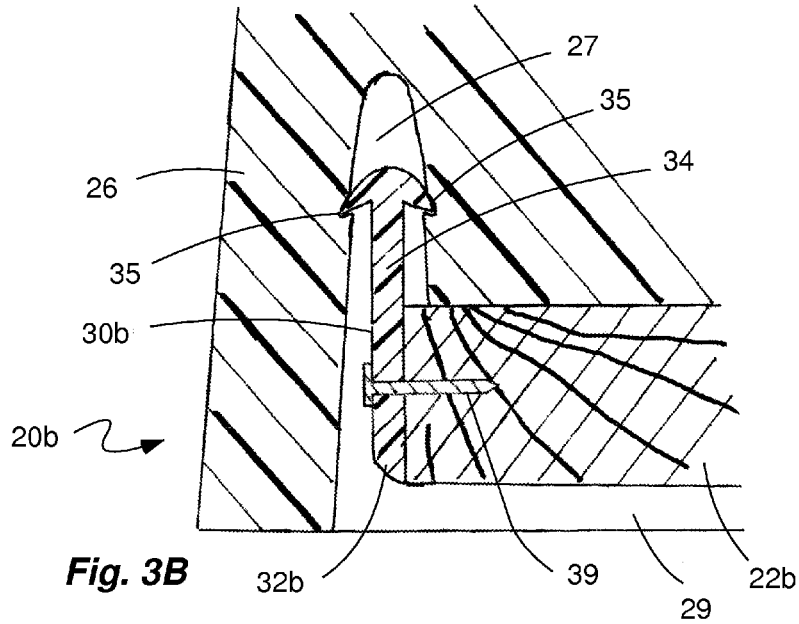
FIG. 3B is a partial cross-sectional view of a variation on the embodiment of FIG. 3A.

FIG. 3B is a partial cross-sectional view of a variation on the cushioned support 20 described above. In this case, retaining member 30*b* is secured to base 22 with nail 39 or a similar fastener, such as a staple or screw, driven through the first portion 32*b* of retaining member 30*b* and into base 22.

Figure 4:
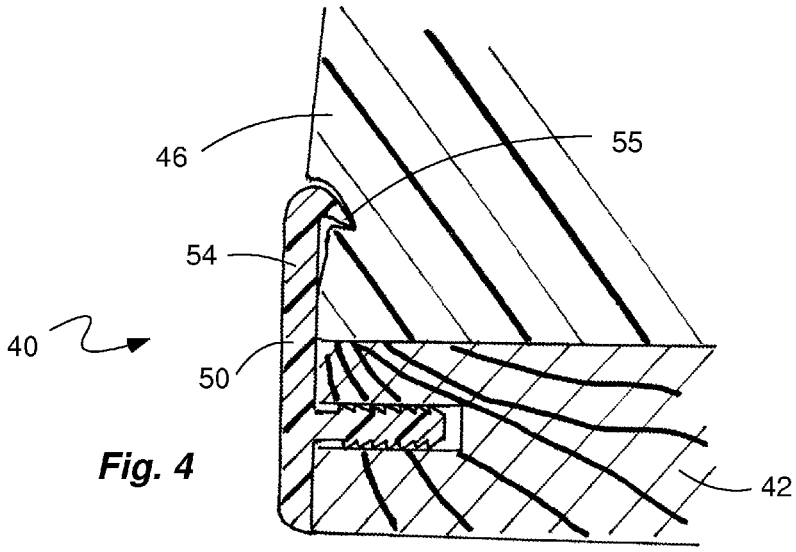
FIG. 4 is a partial cross-sectional view of another embodiment of the present invention.

FIG. 4 is a partial cross-sectional view of another embodiment of a cushioned support 40. The construction is similar to that of cushioned support 20, except that here the cushion 46 does not have a recess to receive the base 42. Retaining member 50 is similar to retaining member 30, except that the second portion 54 is formed with only a single barb 55. Retaining member 50 can also be made similar to retaining member 30*b*, wherein the retaining member would be attached to base 42 by means of nails or other similar mechanical fasteners.

Figure 5:
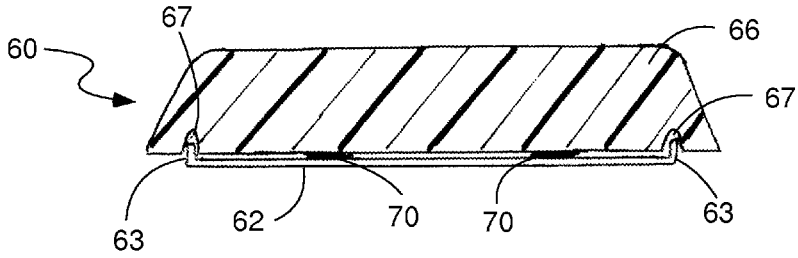
FIG. 5 is a cross-sectional view of yet another embodiment of the present invention.

FIG. 5 is a cross-sectional view of yet another embodiment of a cushioned support 60. In this embodiment, base 62 is formed with a peripheral rim 63. Base 62 may be conveniently formed of metal in the shape of a shallow pan. Cushion 66 is formed with a channel 67 to receive rim 63. Cooperating lengths of hook and loop material 70 are attached to base 62 and cushion 66, respectively, to retain the cushion on the base.

Figure 6:
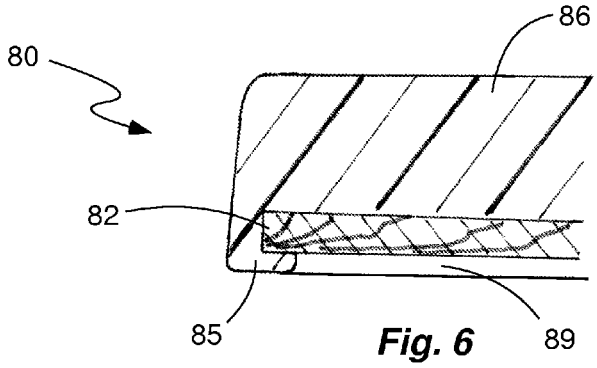
FIG. 6 is a partial cross-sectional view of still another embodiment of the present invention.

FIG. 6 is a partial cross-sectional view of still another embodiment of a cushioned support 80. In this embodiment, cushion 86 is formed with a recess 89 having a lip 85 that wraps around the edge of base 82. The lip may have cut-outs to accommodate frame members to which the base is attached. Furthermore, the lip may only partially surround the edge of base 82, such as in the corners or at spaced-apart locations. In this embodiment, no separate retaining member is required. Cushion 86 and base 82 may have cooperating pegs and sockets as in the first described embodiment or may be secured to each other with hook and loop material as described in connection with cushioned support 60 shown in FIG. 5.

The cushions of the various embodiments may be molded in a variety of colors, textures and shapes. This allows exercise machines and other items with cushioned supports to be offered with low cost upholstery options since colors, textures and shapes may be changed by simply replacing the cushions; the rigid bases remain attached to the structure. Replacement cushions are lighter and less expensive than replacements for the entire cushioned support.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A cushioned support for an exercise apparatus comprising:

a rigid base;

a molded resilient cushion configured to fit on the base;

a retaining member disposed along a periphery of the base having a first portion securing the retaining member to the base and a second portion extending away from the base along a sidewall of the cushion, said second portion having an inwardly facing barb engaging the sidewall of the cushion;

wherein the cushion is retained on the base solely by the barbed portion of the retaining member gripping against the resilient cushion such that the cushion is releasable from and re-attachable to the combined base and retaining member.

2. The cushioned support of claim 1 wherein the first portion of the retaining member is received in a cooperating channel in the periphery of the base.

3. The cushioned support of claim 1 wherein a surface of the cushion facing the base includes at least one projecting peg received in a cooperating socket in the base.

4. The cushioned support of claim 1 wherein the cushion comprises a molded foam.

5. The cushioned support of claim 1 wherein the retaining member comprises an extruded molding.

6. An exercise device comprising:

a frame;

at least one operable member movable with respect to the frame for performing an exercise;

a support attached to the frame for supporting a user while performing the exercise using the operable member, wherein the support comprises a rigid base attached to the frame and a resilient cushion;

a retaining member attached to the base and configured to secure the cushion on the base solely by gripping against the resilient cushion;

wherein the cushion is non-permanently attachable to the base by temporarily deforming the cushion so as to engage the retaining member and wherein the cushion is releasable from the base by temporarily deforming the cushion so as to disengage the retaining member.

7. The exercise device of claim 6 further wherein the retaining member is disposed along a periphery of the base and has a first portion securing the retaining member to the base and a second portion engaging the cushion.

8. The exercise device of claim 7 wherein the second portion of the retaining member comprises a barb.

9. The exercise device of claim 7 wherein the first portion of the retaining member is received in a cooperating channel in the periphery of the base.

10. The exercise device of claim 7 wherein the cushion includes a molded-in feature configured for cooperative engagement with the second portion of the retaining member.

11. The exercise device of claim 6 wherein the cushion is recessed to receive the base.

12. The exercise device of claim 6 wherein the cushion comprises a molded cushion.

* * * * *